US010021477B2

(12) United States Patent
Kim

(10) Patent No.: US 10,021,477 B2
(45) Date of Patent: Jul. 10, 2018

(54) BACKWARD COMPATIBLE SYSTEM AND METHOD FOR USING 4P AUDIO JACK TO PROVIDE POWER AND SIGNAL TO HEADSET WITH ACTIVE NOISE CANCELLATION

(71) Applicant: Maxim Integrated Products, Inc., San Jose, CA (US)

(72) Inventor: Sang Hoon Kim, Glenview, IL (US)

(73) Assignee: Maxim Integrated Products, Inc., San Jose, CA (US)

( * ) Notice: Subject to any disclaimer, the term of this patent is extended or adjusted under 35 U.S.C. 154(b) by 0 days.

(21) Appl. No.: 14/846,492

(22) Filed: Sep. 4, 2015

(65) Prior Publication Data

US 2016/0249127 A1 Aug. 25, 2016

Related U.S. Application Data

(60) Provisional application No. 62/120,457, filed on Feb. 25, 2015.

(51) Int. Cl.

| | |
|---|---|
| ***H04R 5/02*** | (2006.01) |
| ***H04R 1/10*** | (2006.01) |
| ***G10K 11/178*** | (2006.01) |

(52) U.S. Cl.

CPC ..... *H04R 1/1083* (2013.01); *G10K 11/178* (2013.01); *G10K 11/1788* (2013.01); *G10K 2210/1081* (2013.01); *G10K 2210/3031* (2013.01); *H04R 1/1041* (2013.01); *H04R 2201/107* (2013.01); *H04R 2410/05* (2013.01); *H04R 2420/09* (2013.01)

(58) Field of Classification Search

CPC ..... G10K 11/1788; G10K 2210/1081; G10K 2210/3031; H04R 1/1041; H04R 1/1083; H04R 2201/107; H04R 2410/05; H04R 2420/09

USPC ..... 381/58, 59, 74, 95, 107, 109, 111, 122, 381/123, 11; 439/620.01; 455/557, 455/575.2; 379/428.02, 430, 431

See application file for complete search history.

(56) References Cited

U.S. PATENT DOCUMENTS

| | | | | |
|---|---|---|---|---|
| 7,283,635 | B1 * | 10/2007 | Anderson | H04M 1/60 381/384 |
| 2009/0179768 | A1 * | 7/2009 | Sander | H04M 1/05 340/13.27 |
| 2010/0303251 | A1 * | 12/2010 | Im | H04R 1/1041 381/74 |
| 2011/0098085 | A1 * | 4/2011 | Stenmark | H04M 1/72527 455/557 |

(Continued)

*Primary Examiner* — Vivian Chin
*Assistant Examiner* — Friedrich W Fahnert
(74) *Attorney, Agent, or Firm* — North Weber & Baugh LLP

(57) ABSTRACT

A backward compatible system and method for using 4P audio jack in an electronic device to provide power and signal to headset with active noise cancellation (ANC) as well as accessories that require an external power are disclosed. The method involves automatically deciding at the electronic device accessory type after accessory insertion detected and choosing proper accessory communication mode based at least on the decided accessory type and accessory input signal. The accessory communication mode may be an accessory power mode or an accessory microphone mode.

19 Claims, 7 Drawing Sheets

(56) References Cited

U.S. PATENT DOCUMENTS

| | | | | |
|---|---|---|---|---|
| 2012/0051554 | A1* | 3/2012 | Modi | H04R 5/04 381/74 |
| 2014/0038460 | A1* | 2/2014 | Lee | H04R 29/004 439/620.01 |
| 2014/0241535 | A1* | 8/2014 | Poulsen | H04R 29/001 381/58 |
| 2015/0304769 | A1* | 10/2015 | Weijand | H04R 1/1041 381/123 |
| 2015/0312691 | A1* | 10/2015 | Virolainen | H04R 29/005 381/58 |

* cited by examiner

BACKWARD COMPATIBLE SYSTEM AND METHOD FOR USING 4P AUDIO JACK TO PROVIDE POWER AND SIGNAL TO HEADSET WITH ACTIVE NOISE CANCELLATION

CROSS-REFERENCE TO RELATED APPLICATIONS

The application claims priority to U.S. Provisional Patent Application 62/120,457, entitled "Backward Compatible System and Method for Using 4P Audio Jack to Provide Power and Signal to Headset with Active Noise Cancellation," filed Feb. 25, 2015, which application is hereby incorporated herein by reference in its entirety.

BACKGROUND

A. Technical Field

The present invention relates generally to accessory management and data communication via an audio port on an electronic device.

B. Background of the Invention

Audio sockets have been commonly used in various electronic devices, such as computers, laptops, media players, smart phones, etc. to communicate with audio accessories having audio jacks. The mostly common used jack plugs have 2.5 mm, 3.5 mm or 6.35 mm (¼ inch) configurations with 2, 3 or 4 conductors (2P, 3P or 4P) for mono, stereo or stereo plus microphone compatibility. Stereo 3.5 mm jacks may be used for line in/out, headset out, loudspeaker out, microphone in, etc. Three-conductor connectors are common on older electronic devices, while 4-conductor 3.5 mm connectors are more commonly used on modern electronic devices, including most smart phones.

A 2-conductor jack is called TS connector with a tip and a sleeve for mono audio communication. A 3-conductor jack is called TRS connector with a tip, a ring and a sleeve for stereo audio communications. A 4-conductor jack is usually called TRRS connector with a tip, two rings and a sleeve for stereo plus microphone line communications. In certain circumstances, it is desirable to use a TRRS jack to transmit additional audio and/or data signal to host electronic devices.

Beyond receiving audio signal input from electronic device, some audio accessory, such as headset with active noise control (ANC) also need power input to operate its noise control circuit. Traditionally, the ANC headset is powered by separate battery, which causes bulky size for the headset and limited operation time.

Efforts have been done to explore further potential applications using audio jack connection. 5-conductor jack has been proposed and developed recently. However, it is very difficult to make those 5-conductor jacks backward compatible to most modern electronic devices. Additional cost will be needed for customer connector and hardware for 5-conductor jacks. Given the variety in the audio accessories of different characteristics and preferred settings, it would be desirable to provide improved accessory management and signal communication via 4P audio port with backward compatibility for supporting interactions between electronic devices and accessories.

SUMMARY OF THE INVENTION

The invention relates to accessory management and data communication, and more particularly, to backward compatible systems and methods for using 4P audio jack in an electronic device to provide power and signal to headset with active noise cancellation (ANC) as well as accessories that require an external power.

The method involves automatically deciding at the electronic device accessory type after accessory insertion detected and choosing accessory communication mode based at least on the decided accessory type and accessory input signal. The accessory communication mode may be an accessory power mode or an accessory microphone mode. In the accessory power mode, the electronic device provides power to the accessory over a microphone line (MIC line) operated beyond traditional microphone bias voltage level. In the accessory microphone mode, the electronic device provides MIC bias and audio signals to the accessory.

In certain embodiments, communication starts after the jack insertion is detected. The accessory's ID and audio jack configuration are initially checked. The audio jack configuration check verifies the type of the audio jack (TS, TRS or TRRS jack) and also the type of the accessory. The accessory type detection method includes impedance detection of audio lines as well as MIC line.

If the accessory is detected to be a traditional 4P headset, the electronic device provides MIC bias and audio signals to the 4P headset. If the accessory is detected to be a 4P accessory requesting power support, the host electronic device provides power to the accessory over the microphone line (MIC line).

In certain embodiments, some accessories have one audio line (L-audio or R-audio) multiplexed with the MIC line. The electronic device detects and monitors microphone bias on at least one audio line, such as L-audio or R-audio line. If the microphone bias is detected and is higher than $V_{ref1}$ for duration of time longer than $t_{deb1}$, then the audio line is being used as a microphone and the electronic device routes the audio line as a microphone input and turn on an audio bypass switch. If the microphone bias is lower than $V_{ref1}$ for duration of time longer than $t_{deb1}$, the electronic device latches the audio line for audio signal output from an audio drive circuit within the electronic device.

In certain embodiments, when the electronic device provides power to the accessory over the microphone line (MIC line), the MIC line voltage is monitored. If the MIC line voltage is below the $V_{ref2}$ for duration of time longer than $t_{deb2}$, the electronic device is not supporting the accessory power mode and the accessory operates in low power mode (legacy mode) and optional bypass mode.

BRIEF DESCRIPTION OF THE DRAWINGS

Reference will be made to exemplary embodiments of the present invention that are illustrated in the accompanying figures. Those figures are intended to be illustrative, rather than limiting. Although the present invention is generally described in the context of those embodiments, it is not intended by so doing to limit the scope of the present invention to the particular features of the embodiments depicted and described.

One skilled in the art will recognize that various implementations and embodiments of the invention may be practiced in accordance with the specification. All of these implementations and embodiments are intended to be included within the scope of the invention.

DETAILED DESCRIPTION OF THE PREFERRED EMBODIMENTS

In the following description, for the purpose of explanation, specific details are set forth in order to provide an understanding of the present invention. The present invention may, however, be practiced without some or all of these details. The embodiments of the present invention described below may be incorporated into a number of different electrical components, circuits, devices, and systems. Structures and devices shown in block diagram are illustrative of exemplary embodiments of the present invention and are not to be used as a pretext by which to obscure broad teachings of the present invention. Connections between components within the figures are not intended to be limited to direct connections. Rather, connections between components may be modified, re-formatted, or otherwise changed by intermediary components.

When the specification makes reference to "one embodiment" or to "an embodiment", it is intended to mean that a particular feature, structure, characteristic, or function described in connection with the embodiment being discussed is included in at least one contemplated embodiment of the present invention. Thus, the appearance of the phrase, "in one embodiment," in different places in the specification does not constitute a plurality of references to a single embodiment of the present invention.

Various embodiments of the invention are used for accessory management and data communication via audio port in systems comprised of one or more integrated circuits (IC). An IC may be a memory, microcontroller, microprocessor, secure authenticator or any other devices within a system that communicates and/or receives information within the system. These systems, and the IC(s) therein, may be integrated on a single component or contain discrete components. Furthermore, embodiments of the invention are applicable to a diverse set of techniques and methods.

Figure 1:
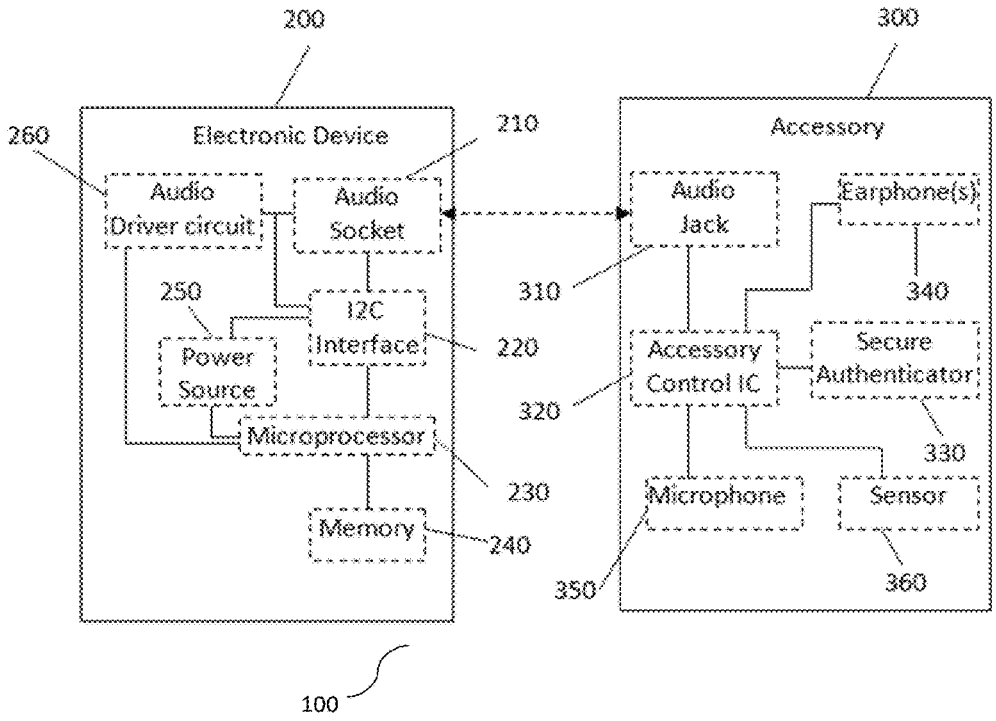
FIG. 1 is a schematic diagram of an electronic device in communication with an accessory in a system via an audio jack in accordance with an embodiment of the present invention.

FIG. 1 shows a schematic diagram of a system 100 according to various embodiments of the invention. The system 100 comprises an electronic device 200 in communication with an accessory 300. Communication between the device and the accessory begins after an audio jack 310 on the accessory 300 inserts into an audio socket 210 on the electronic device 200. The electronic device may detect the type of the accessory and communicates to the accessory in different operation modes accordingly. On the other hand, the accessory may detect the capacity and operation mode of the electronic device and adjust accessory configurations based on the detected operation mode.

The electronic device 200 may be a computer device, a laptop, a portable media player, such as a MP3 player, a smart phone, etc. The accessory 300 may be an audio accessory such as a microphone, a headphone, loudspeakers, an audio amplifier, or be an electronic accessory having audio jack for voice and data communications. In an embodiment, the accessory 300 has a stereo or mono earphone and a microphone for audio input to the electronic device 200.

The audio socket 210 is a 4P audio socket. The audio jack 310 may have 2.5 mm, 3.5 mm or 6.35 mm (¼ inch) configurations with 2, 3, 4 or even 5 conductors for mono, stereo, stereo plus microphone, and stereo plus microphone with power compatibility.

In one embodiment, the electronic device 200 has an audio socket 210, an I2C interface 220, a microprocessor 230, a memory 240, a power source 250 and an audio driver circuit 260. The microprocessor 230 is configured to operatively connect to the I2C interface 220, the memory 240, the power source 250 and the audio driver circuit 260. The I2C interface 220 is an Inter-Integrated Circuit used for attaching peripheral audio socket 210 to the microprocessor 230. The memory 240 is configured to store a non-volatile computer readable logic or code for the implementation of desired function when the logic or code is executed by the microprocessor 230.

In one embodiment, the accessory 300 comprises an accessory control IC 320, an audio jack 310 and an earphone 340. In another embodiment, the accessory 300 has a microphone 350 coupled to the accessory control IC 320. In yet another embodiment, the accessory 300 also has a secure authenticator 330 and an audio sensor 360 for noise control purpose. In some embodiment, the accessory control IC 320 may be an active noise control (ANC) circuit or a stereo speaker balance circuit, etc. The accessory control IC 320 couples to the audio jack 310, the earphone 340, audio sensor 360, and the microphone 350. In some embodiments, the audio sensor 360 is a stereo audio sensor comprising an L-audio sensor 362, R-audio sensor 364.

Figure 2:
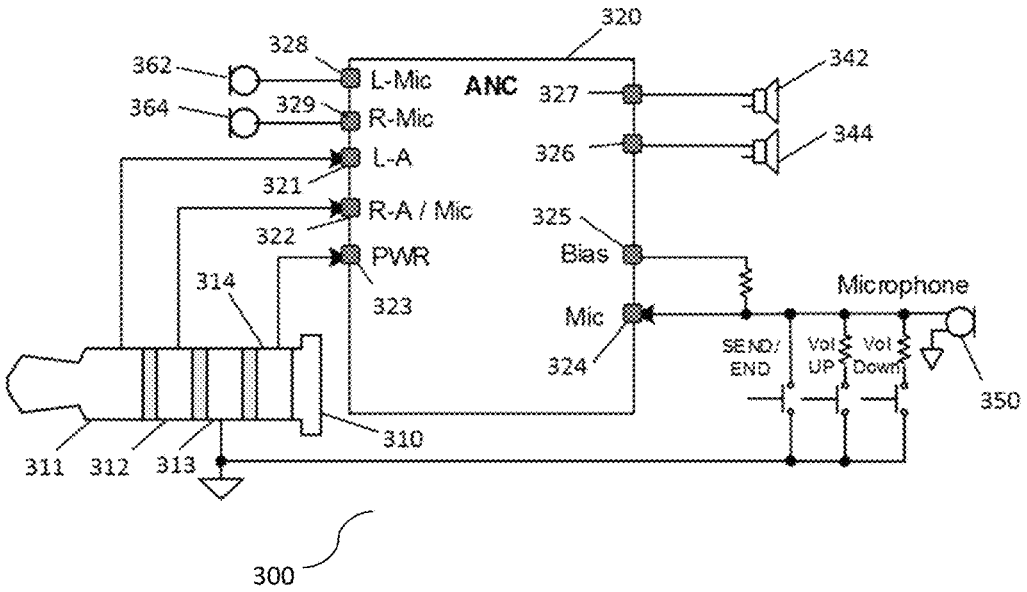
FIG. 2 is an exemplary schematic diagram of an accessory according to various embodiments of the invention.

FIG. 2 illustrates an exemplary schematic diagram of an accessory according to various embodiments of the invention. The accessory 300 has a TRRS audio jack 310, a stereo earphone 340 (L-earphone 342 and R-earphone 344), a microphone 350, an accessory control IC 320 and a secure authenticator 330. The audio jack 310 comprises an L-audio conductor 311, an R-audio conductor 312, a ground conductor 313 and a microphone conductor 314. The L-audio conductor 311, R-audio conductor 312 and a microphone conductor 314 are connect to L-audio input port 321, R-audio input port 322 and power input port (PWR) 323 of the accessory control IC 320 respectively.

The accessory control IC 320 also comprises an L-Mic port 328, a R-Mic port 329, a L-audio output port 326, R-audio output port 327 operatively connected to the L-audio sensor 362, R-audio sensor 364, L-earphone 342 and R-earphone 344, respectively. During the operation of the accessory 300, audio jack 310 is inserted to the audio socket 210 of the electronic device 200 for audio/MIC signal communication. The accessory control IC 320 receives audio signal inputs from the audio jack 310 and the audio sensor 360, processes those signals via internal signal processing circuit (not shown in FIG. 2) and generates outputs signals to the earphone 340.

In another embodiment, the accessory control IC 320 comprises a MIC input port 324 and a MIC bias port 325 to receive/output signal to the microphone 350. The accessory control IC 320 may be operated to receive signal input from the microphone 350 and send the signal to the electronic device 200 through the microphone conductor 314. The accessory control IC 320 may be alternatively operated to receive bias input from the electronic device 200 via the microphone conductor 314 and output the bias signal to the microphone 350 through the MIC bias port 325. The accessory control IC 320 may also be operated to receive digital communication such as 1-wire or ultra sound input from the electronic device 200 via the microphone conductor 314 and output the bias signal to the microphone 350 through the MIC bias port 325.

Figure 3:
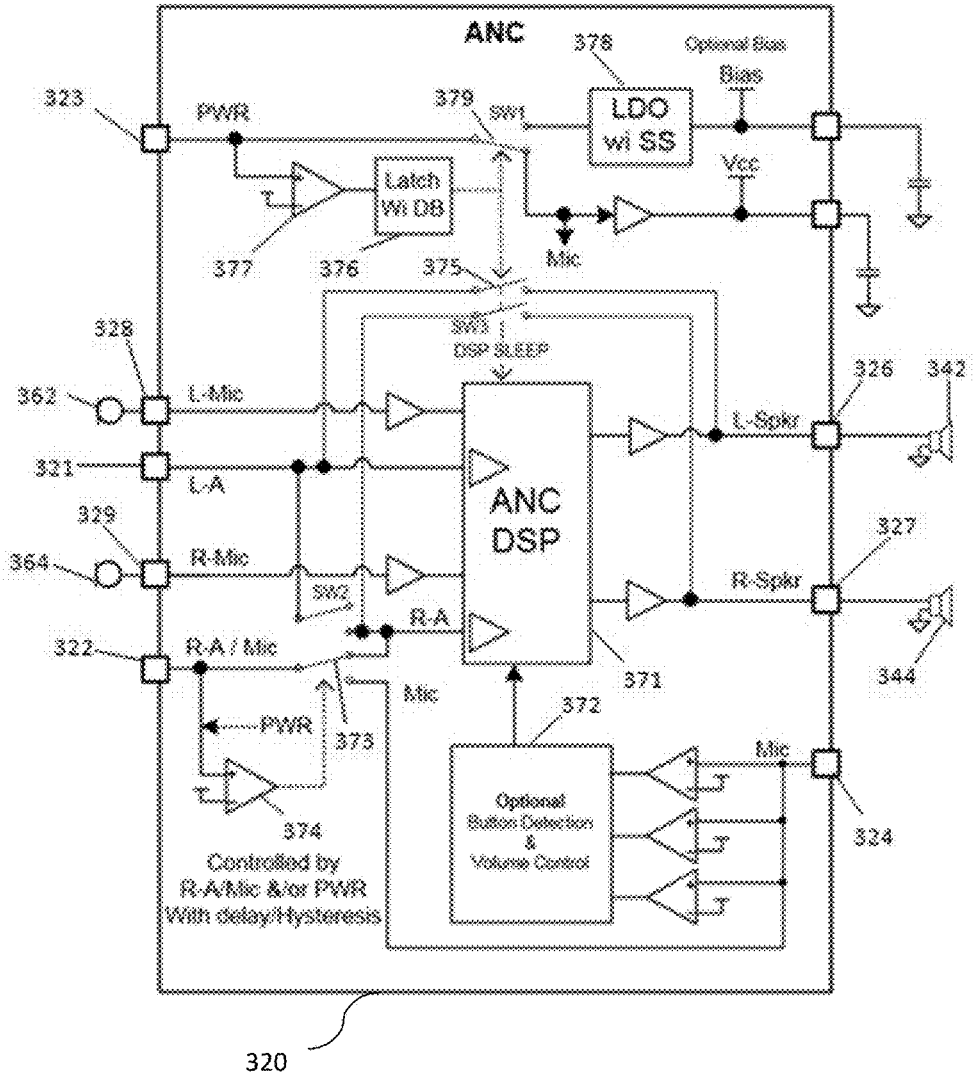
FIG. 3 is an exemplary schematic diagram of the accessory control IC according to various embodiments of the invention.

FIG. 3 illustrates an exemplary schematic diagram of accessory control IC according to various embodiments of the invention. The accessory control IC 320 comprises a digital signal processing (DSP) circuit 371, a R-audio/MIC selection switch 373, a low dropout regulator (LDO) 378, a LDO switch 379, a MIC line voltage comparator 374 and a power line voltage comparator 377. The DSP circuit 371 couples between signal input ports (L-audio input port 321, R-audio input port 322, L-Mic port 328 and R-Mic port 329) and audio output ports (L-audio output port 326 and R-audio output port 327). The DSP circuit 371 may be a DSP (digital signal processing) circuit for ANC or power accessory applications. In one embodiment, the accessory control IC 320 also comprises an optional button detection interface 372 to detect/receive button operations and send the detected operations to the DSP circuit 371 for further processing. In another embodiment, the LDO 378 comprises soft-start circuit to limit inrush current and control output voltage rising time during power-up.

The power line voltage comparator 377 has one input coupled to the power input port (PWR) 323 and compares the voltage at the power input port to a predetermined threshold voltage. The output of the power line voltage comparator 377 is coupled to the LDO switch 379 via a latch component 376 with a predetermined debounce time to switch ON/OFF the LDO switch 379. In one embodiment, the predetermined threshold voltage is an input voltage required to operate the LDO 378. In one embodiment, the predetermined threshold voltage is set at 2.8V. When the voltage at the power input port is larger or equal to the predetermined threshold voltage, the LDO switch 379 is switched ON to enable LDO 378 operation and thus provide power to the DSP circuit 371.

In one embodiment, the accessory control IC 320 comprises a bypass switch 375 coupled between signal input ports (L-audio input port 321, R-audio input port 322) and output ports (L-audio output port 326 and R-audio output port 327). In one embodiment, the bypass switch 375 is a double pole, single throw (DPST) switch. When the bypass switch 375 is closed, the L-audio input port 321 and R-audio input port 322 are connected to the L-audio output port 326 and R-audio output port 327 directly, thus bypassing the DSP circuit 371.

In one embodiment, the R-audio/MIC selection switch 373 is a DPDT switch. When the R-audio/MIC selection switch 373 is switched ON (closed), the R-audio input port 322 connects to the MIC input port 324 directly and is used as a MIC communication port to transfer MIC input from the microphone 350 to the electronic device. At the same time, the L-audio input port 321 couples to both L-audio output port 326 and R-audio output port 327 for mono audio signal output. The earphone 340 (L-earphone 342 and R-earphone 344) thus operates in a mono mode.

In one embodiment, the R-audio/MIC selection switch 373 is controlled by the MIC line voltage comparator 374, which compares the voltage at the R-audio input port 322 to at least one reference voltage. In one embodiment, the R-audio/MIC selection switch 373 is controlled by the MIC line voltage comparator 374 and/or the power line voltage comparator 377.

One skilled in the art will recognize that the above-described accessory control IC is only one structure example. In one embodiment, the DSP circuit 371, LDO 378, stitches 373 and 375, voltage comparators 374 and 377 may be integrated within one IC chip. In another embodiment, those components may be placed among a plurality of IC chips. The DSP circuit 371 may also comprise embedded memory storage module to store preloaded logic codes executable by the DSP circuit to implement desired active noise control processing.

Figure 4:
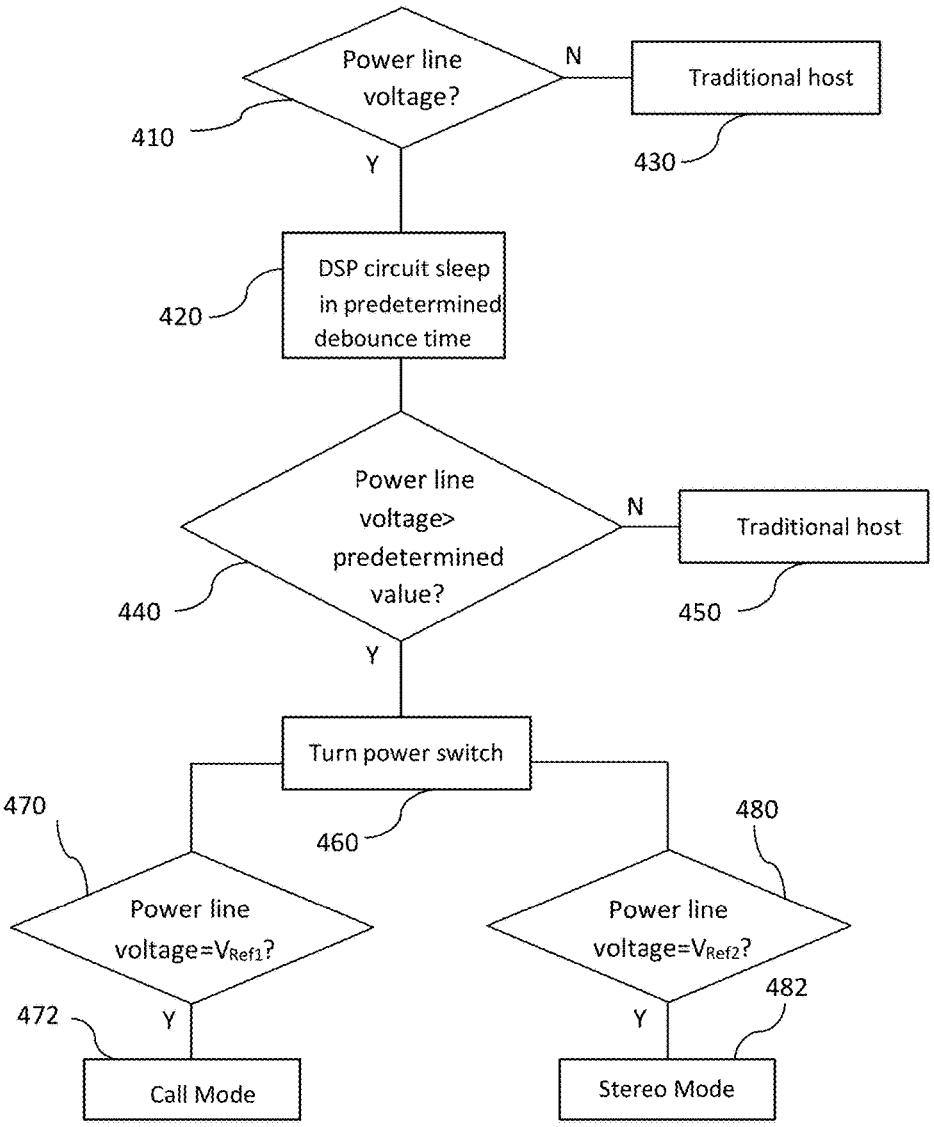
FIG. 4 is an exemplary block diagram of the accessory in communication with an electronic device for host detection according to various embodiments of the invention.

FIG. 4 is an exemplary block diagram of the accessory in communication with an electronic device for host detection according to various embodiments of the invention.

Communication between the accessory 300 and the electronic device 200 starts after the audio jack 310 of the accessory 300 is inserted into the audio socket of an electronic device. At step 410, the accessory control IC 320 checks whether the microphone conductor (MIC line) 314 has a power line voltage. If not, the accessory control IC 320 verifies that the electronic device 200 is a traditional host not providing power support to accessory via 4P audio socket at step 430. If the microphone line (PWR) voltage is present (in step 420), the accessory control IC 320 is configured to draw no more than a minimum allowable current for a predetermined debounce time. Moreover, the DSP circuit 371 is in sleep mode. After the predetermined debounce time, the power line voltage at the microphone conductor (MIC line) 314 is compared to a predetermined voltage at step 440. In one embodiment, the predetermined voltage is the working voltage for the LDO 378. In another embodiment, the predetermined voltage is set as 94% of LDO working voltage based on I2C communication PIO level. For example, the predetermined voltage may be set at 2.5V. If the power line voltage is less than the predetermined voltage, the accessory control IC 320 verifies that the electronic device 200 does not provide power support over MIC line via 4P audio socket at step 450. The electronic device may be a traditional host supporting stereo audio output and MIC signal input. If the power line voltage is larger than the predetermined voltage, the accessory control IC 320 verifies that the electronic device 200 supports power input over MIC line via 4P audio socket at step 460. The power switch 379 is then switched to latch the LDO 378 to the power input port (PWR) 323 such that the DSP circuit 371 is powered up.

In some embodiments, the power line voltage is further verified to check whether the voltage is the same as a first reference voltage $V_{Ref1}$ at step 470. The first reference voltage $V_{Ref1}$ is higher than the predetermined voltage. If yes, the accessory enters a mono mode (or a call mode for a phone electronic device, such as a smart phone) at step 472 and the accessory control IC 320 is configured to switch ON the R-audio/MIC selection switch 373 to connect the R-audio input port 322 to the MIC input port 324 directly. At the same time, the L-audio input port 321 couples to both L-audio output port 326 and R-audio output port 327 for mono audio signal output. In one embodiment, the first reference voltage $V_{Ref1}$ is set as 3.15V.

In some embodiments, the power line voltage is also verified to check whether the voltage is the same as a second reference voltage $V_{Ref2}$ at step 480. The second reference voltage $V_{Ref2}$ is higher than the predetermined voltage but lower than the first reference voltage $V_{Ref1}$. If yes, the accessory enters a stereo mode at step 482, wherein the R-audio input port 322 is coupled to the R-audio output port 327 to provide a stereo audio output together with the L-audio output port 326. In one embodiment, the second reference voltage $V_{Ref2}$ is set as 2.8V.

Figure 5:
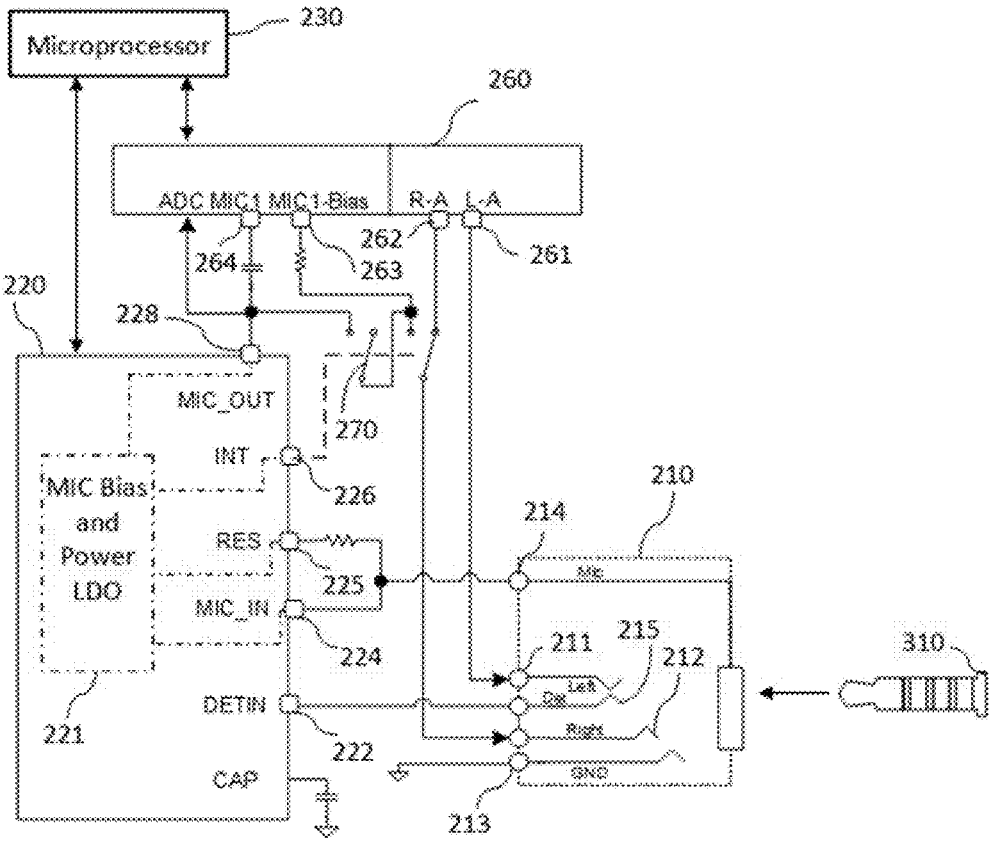
FIG. 5 is an exemplary schematic diagram of an electronic device according to various embodiments of the invention.

FIG. 5 is an exemplary schematic diagram of an electronic device according to various embodiments of the invention. The electronic device 200 has an audio socket 210 to receive an audio jacket from an accessory, an I2C circuit 220, a microprocessor 230, and an audio driver circuit 260. The electronic device also has other components (not shown in FIG. 5) including memory, power source and at least one I/O interface, such as touch screen, keyboard, pin pad, etc. The microprocessor 230 is configured to couple to the I2C circuit 220 and the audio driver circuit 260 (and also the memory, the power source and I/O interfaces).

The audio socket 210 comprises an L-audio socket conductor 211, a R-audio socket conductor 212, a socket ground conductor 213 and a socket microphone conductor 214, which respectively contact the L-audio conductor 311, R-audio conductor 312, ground conductor 313 and a microphone conductor 314 after the insertion of the audio jack 310. In one embodiment, the audio socket 210 comprises an audio insertion detection conductor 215 to contact the L-audio conductor 311 after the audio jack 310 insertion. The audio insertion detection conductor 215 couples to the I2C circuit 220 via pin 222 and is configured to detect audio jack insertion.

The L-audio socket conductor 211 couples to an L-A (left audio output) port 261 of the audio driver circuit 260 to receive audio signal. The R-audio socket conductor 212 couples to either an R-audio output port 262 or a MIC-bias port 263 of the audio driver circuit 260 via a controllable switch 270. In one embodiment, the controllable switch 270 is a DPDT (double pole double through) switch such that when the R-audio socket conductor 212 is able to couple to both the MIC-bias port 263 and an MIC port 264 of the audio driver circuit 260 simultaneously. The controllable switch 270 is controlled by the microprocessor 230 or by a MIC Bias and Power LDO 221 within the I2C circuit 220. The MIC Bias and Power LDO 221 sends an INT signal to the controllable switch 270 through pin 226 for switch control according to electronic device audio setup preferences.

The MIC Bias and Power LDO 221 may couple to the socket microphone conductor 214 via a MIC IN pin 224 to send power or to receive signal from the microphone conductor 314. The MIC Bias and Power LDO 221 may also couple to the socket microphone conductor 214 via a RES (reset) pin 225 to send power to or to receive signal from the accessory 300 via the microphone conductor 314. The voltage output from the MIC Bias and Power LDO 221 to the RES (reset) pin 225 is configurable to be different levels according to electronic device audio setup preferences.

Figure 6:
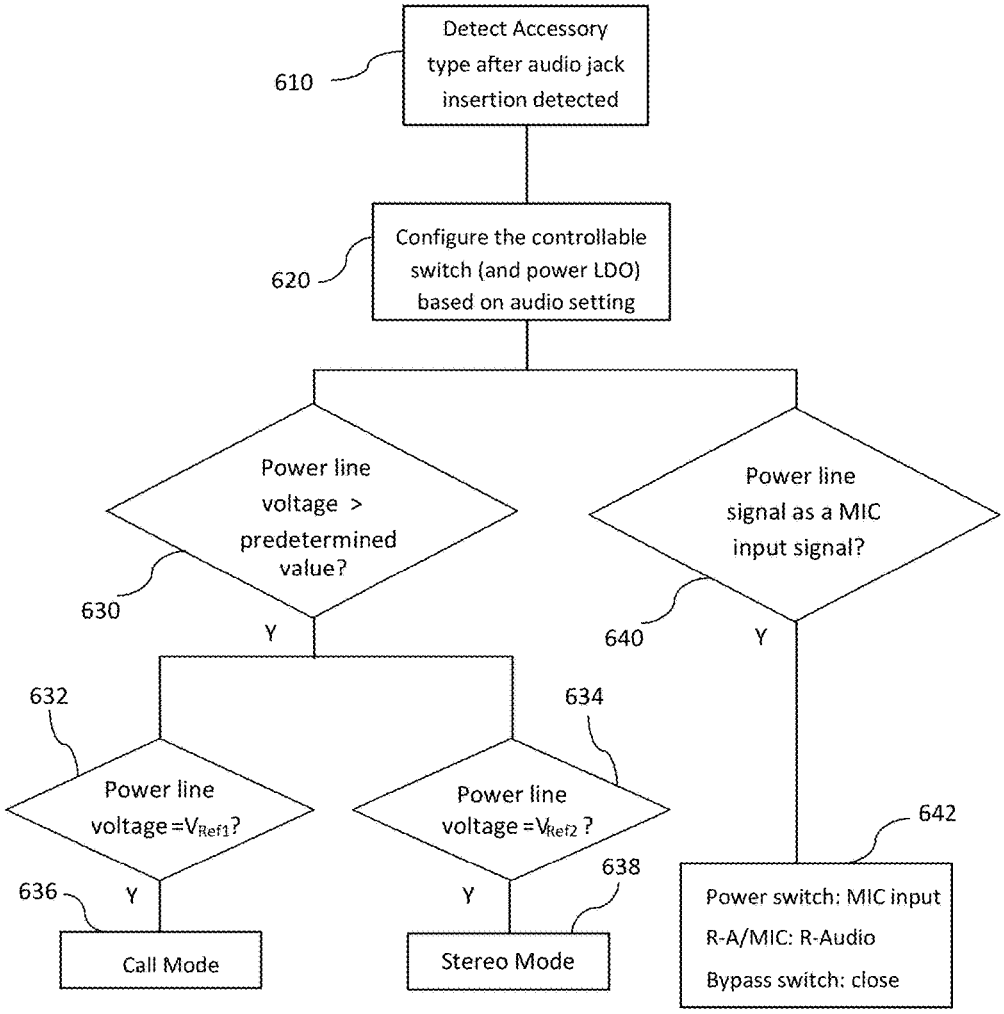
FIG. 6 is an exemplary block diagram of the accessory in communication with an electronic device for accessory detection according to various embodiments of the invention.

FIG. 6 is an exemplary block diagram of the accessory in communication with an electronic device for accessory detection according to various embodiments of the invention. At step 610, the electronic device detects the types of accessory after audio jack insertion detected. The accessory detection may be done by checking the impedance at the L-Audio line 311 and/or the MIC line 314 and/or the secure authenticator 330. The secure authenticator 330 could be also a digital ID as well as a secure authenticator.

At step 620, the electronic device configures the control setup for the controllable switch 270 based on preferred audio setting. In some embodiments, the electronic device is a smart phone and the controllable switch 270 may be configured as mono mode for phone calls and stereo mode for music playing. At mono mode, the R-audio socket conductor 212 is latched both the MIC-bias port 263 and an MIC port 264 of the audio driver circuit 260. At stereo mode, the R-audio socket conductor 212 is latched to R-audio output port 262 of the audio driver circuit 260. In some embodiments, the electronic device also configures the MIC bias and power LDO 221 based on preferred audio setting. For example, the LDO 221 may output a voltage of $V_{Ref1}$ when the electronic device is in mono mode for phone calls and output a voltage of $V_{Ref2}$ when the electronic device is in stereo mode for music playing. In some embodiments, the first reference voltage $V_{Ref1}$ is higher than the second reference voltage $V_{Ref2}$. For example, the first reference voltage $V_{Ref1}$ may be set as 3.15V and the second reference voltage $V_{Ref2}$ may be set as 2.8V.

At step 630, the accessory control IC 320 compares the power line voltage at the microphone conductor (MIC line) 314 to a predetermined voltage. If the power line voltage is larger than the predetermined voltage, the accessory control IC 320 verifies that the electronic device 200 supports power input over MIC line via 4P audio socket. The power switch 379 is then switched to latch the LDO 378 to the power input port (PWR) 323 such that the DSP circuit 371 is powered up. The power line voltage is further verified to check whether the voltage is equal to the first reference voltage $V_{Ref1}$ at step 632. If yes, the accessory enters a mono mode (or a call mode for a phone electronic device, such as a smart phone) at step 636 and the accessory control IC 320 is configured to switch ON the R-audio/MIC selection switch 373 to connect the R-audio input port 322 to the MIC input port 324 directly. At the same time, the L-audio input port 321 couples to both L-audio output port 326 and R-audio output port 327 for mono audio signal output. In one embodiment, the first reference voltage $V_{Ref1}$ is set as 3.15V.

At step 634, the power line voltage is further verified to check whether the voltage is equal to the second reference voltage $V_{Ref2}$. If yes, the accessory enters a stereo mode at step 638, wherein the R-audio input port 322 is coupled to the R-audio output port 327 to provide a stereo audio output together with the L-audio output port 326. Therefore, by controlling the MIC bias and power LDO 221 output voltage to the socket microphone conductor 214, the electronic device may set the operation mode of the accessory according to its preferred audio setting.

At step 640, the accessory control IC 320 checks whether the power line signal at the microphone conductor (MIC line) 314 is a MIC input signal, which is typically smaller than the predetermined voltage. If yes, then the accessory control IC 320 configures to latch the LDO power switch 379 to MIC input, latch the R-A/MIC switch 373 to R-audio signal and close the bypass switch 375 to bypass the DSP circuit 371.

Figure 7:
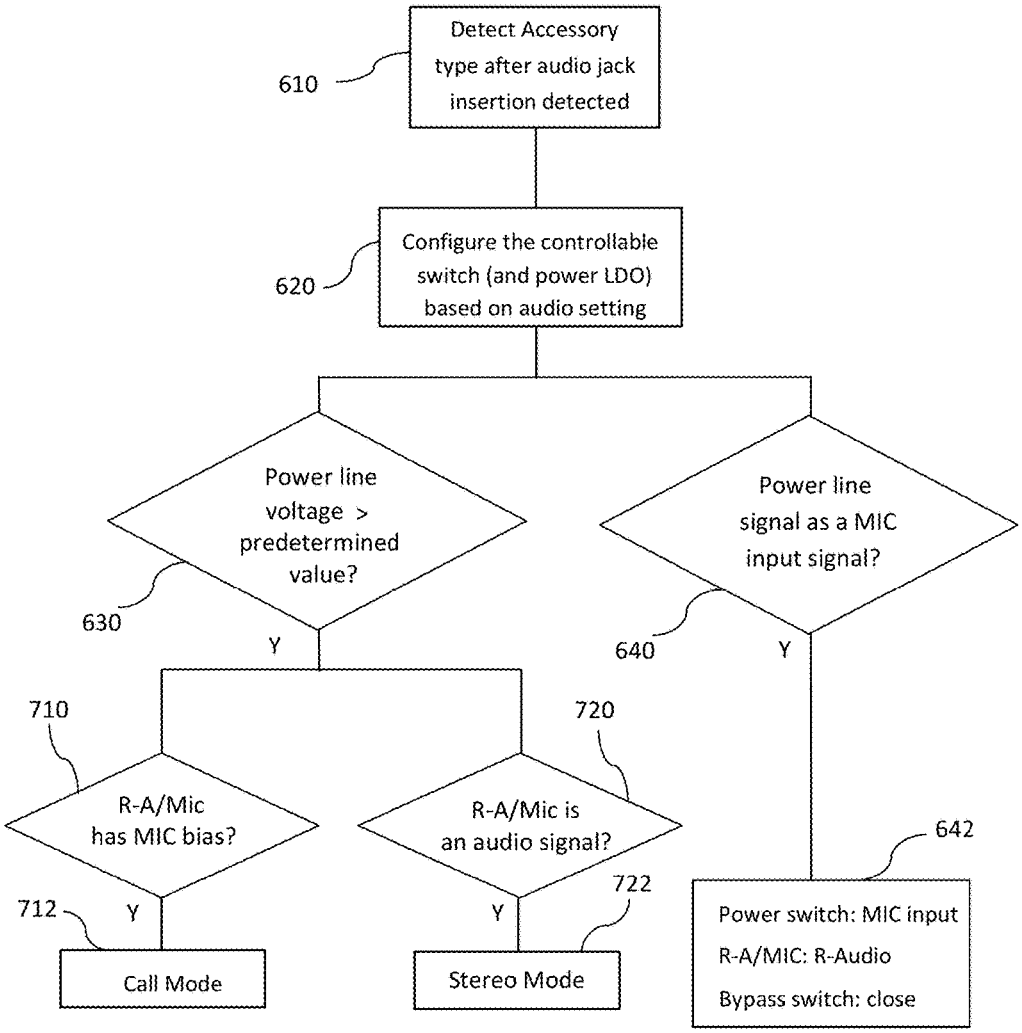
FIG. 7 is another exemplary block diagram of the accessory in communication with an electronic device for accessory detection according to various embodiments of the invention.

FIG. 7 is another exemplary block diagram of the accessory in communication with an electronic device for accessory detection according to various embodiments of the invention. Similar to FIG. 6, at step 630, the accessory control IC 320 compares the power line voltage at the microphone conductor (MIC line) 314 to a predetermined voltage. If the power line voltage is larger than the predetermined voltage, the accessory control IC 320 verifies that the electronic device 200 supports power input over MIC line via 4P audio socket. Then, the accessory control IC 320 checks the signal at the R-audio input port 322. At step 710, the accessory control IC 320 checks if the signal at the R-audio input port 322 has a MIC bias. If yes, the accessory enters a mono mode (or a call mode for a phone electronic device, such as a smart phone) at step 712 and the accessory control IC 320 is configured to switch the R-audio/MIC selection switch 373 to latch the R-audio input port 322 to the MIC input port 324 directly. At the same time, the L-audio input port 321 couples to both L-audio output port 326 and R-audio output port 327 for mono audio signal output.

At step 720, the accessory control IC 320 checks if the signal at the R-audio input port 322 is a regular audio signal, which typically has a lower voltage than the MIC bias voltage. If yes, the accessory enters a stereo mode at step 722, wherein the R-audio input port 322 is coupled to the R-audio output port 327 to provide a stereo audio output together with the L-audio output port 326.

The foregoing description of the invention has been described for purposes of clarity and understanding. It is not intended to limit the invention to the precise form disclosed. Various modifications may be possible within the scope and equivalence of the application.

The invention claimed is:

1. A method for accessory management and communication via an audio socket on an electronic device, the method comprising:

detecting an audio jack insertion from an accessory into the audio socket;

determining an audio jack type and an accessory type at the electronic device;

configuring a control setup based on an audio setting of the electronic device, the control setup being configured by coupling one audio conductor of the audio socket to either an audio output port or a microphone bias port of an audio driver circuit within the electronic device via a controllable switch; and choosing an accessory communication mode based at least on one of the decided accessory type and an accessory input signal.

2. The method of claim 1 wherein choosing the accessory communication mode comprises outputting a predetermined line voltage from the electronic device to a microphone conductor of the audio jack based at least on the control setup.

3. The method of claim 1 wherein the predetermined line voltage is a first reference voltage when the audio setting is in a first mode; and the predetermined line voltage is a second reference voltage when the audio setting is in a second mode, wherein the first reference voltage is higher than the second reference voltage.

4. The method of claim 3 wherein the first mode is a mono mode with a mono audio signal output to the audio accessory and the second mode is a stereo mode with a stereo audio signal output to the audio accessory.

5. The method of claim 1 wherein deciding the accessory type at the electronic device comprises impedance detection of at least one of a left audio conductor, a right audio conductor and a microphone conductor within the audio jack.

6. A method for an audio accessory in communication to a host electronic device via an audio jacket of the audio accessory, the method comprising:

identifying insertion of the audio jacket into an audio socket of the host electronic device, the audio jacket comprising at least one audio conductor and a microphone conductor;

detecting an operation mode of the host electronic device by the audio accessory; and selecting an accessory configuration, by the audio accessory, based at least on the detected operation mode.

7. The method of claim 6 wherein detecting the operation mode of the host electronic device comprises checking whether a line voltage is present on the microphone conductor of the audio jacket.

8. The method of claim 7 wherein if the line voltage is not present, the host electronic device is detected in an operation mode not providing power support to the audio accessory.

9. The method of claim 7 wherein if the line voltage is present, the line voltage is compared to a predetermined voltage, wherein if the line voltage is less than the predetermined voltage, the host electronic device is detected in an operation mode not providing power support to the audio accessory.

10. The method of claim 9 wherein if the line voltage is larger than the predetermined voltage, the host electronic device is detected in an operation mode supporting power input via the audio socket to the audio accessory.

11. The method of claim 10 wherein the audio accessory is configured to receive power input via the microphone conductor of the audio jacket.

12. An audio accessory comprising:

an audio jacket comprising at least one audio conductor and a microphone conductor;

a voltage comparator coupling to the microphone conductor, the voltage comparator comparing a line voltage on the microphone conductor to a predetermined voltage and generating an output; and a controllable switch coupled to the microphone conductor, the controllable switch receiving the output of the voltage comparator for switch control and switchably latching the microphone conductor to a microphone input or a voltage regulator.

13. The audio accessory of claim 12 wherein when the line voltage on the microphone conductor is larger than the predetermined voltage, the controllable switch is switched ON to connect the voltage regulator to the microphone conductor.

14. The audio accessory of claim 12 wherein the audio accessory further comprises a digital signal processing (DSP) circuit and at least one speaker, wherein the DSP circuit couples between the at least one speaker and the at least one audio conductor.

15. The audio accessory of claim 14 wherein the at least one speaker and at least one audio conductor are connected directly with the DSP circuit bypassed when the line voltage on the microphone conductor is less than the predetermined voltage.

16. The audio accessory of claim 14 wherein when the line voltage on the microphone conductor is larger than the predetermined voltage, the DSP circuit is powered by the voltage regulator and the at least one speaker and operated to process signals from the at least one audio conductor.

17. The audio accessory of claim 14 wherein the audio accessory further comprises a selection switch switchably connecting one of the at least one audio conductor to either a microphone input port within the audio accessory or to one of the at least one speaker.

18. The audio accessory of claim 17 wherein the selection switch connects one of the at least one audio conductor to the microphone input port when the audio accessory is in a mono mode.

19. The audio accessory of claim 17 wherein the selection switch connects one of the at least one audio conductor to one of the at least one speaker when the audio accessory is in a stereo mode.

* * * * *